US010382857B1

(12) United States Patent
Khanal et al.

(10) Patent No.: US 10,382,857 B1
(45) Date of Patent: Aug. 13, 2019

(54) AUTOMATIC LEVEL CONTROL FOR PSYCHOACOUSTIC BASS ENHANCEMENT

(71) Applicant: Apple Inc., Cupertino, CA (US)

(72) Inventors: Sarthak Khanal, Cupertino, CA (US); Hannes Breitschaedel, Campbell, CA (US); Vasu Iyengar, Pleasanton, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/939,224

(22) Filed: Mar. 28, 2018

(51) Int. Cl.
*H04R 1/22* (2006.01)
*H04R 3/04* (2006.01)

(52) U.S. Cl.
CPC ..... *H04R 1/22* (2013.01); *H04R 3/04* (2013.01)

(58) Field of Classification Search
CPC ..... H04R 3/04; H04R 1/22; H04R 2203/12; H04R 2201/403; H04R 2201/405
USPC ..... 381/98, 104, 107, 119, 102, 106, 59
See application file for complete search history.

(56) References Cited

U.S. PATENT DOCUMENTS 5,930,373 A * 7/1999 Shashoua ..... G10L 21/038 381/61
6,111,960 A * 8/2000 Aarts ..... H04R 3/04 381/61
6,606,388 B1 * 8/2003 Townsend ..... G10H 1/125 381/1
8,275,152 B2 * 9/2012 Smirnov ..... H03G 5/165 381/102
9,794,688 B2 * 10/2017 You ..... H04R 3/04
9,794,689 B2 * 10/2017 You ..... H04R 3/04
2004/0022400 A1 * 2/2004 Magrath ..... H03G 9/005 381/106
2005/0013446 A1 1/2005 Aarts
2006/0126851 A1 * 6/2006 Yuen ..... H04S 1/005 381/1
2006/0159283 A1 * 7/2006 Mathew ..... H04R 3/04 381/98
2007/0003075 A1 * 1/2007 Cooper ..... H04S 3/00 381/98
2008/0091416 A1 4/2008 Kim et al.
2008/0170721 A1 * 7/2008 Sun ..... G10L 21/038 381/98
2008/0175409 A1 7/2008 Lee et al.
2010/0086148 A1 * 4/2010 Hung ..... H03G 5/165 381/98

(Continued)

OTHER PUBLICATIONS

Aarts, Ronaldus M. et al., "Improving Perceived Bass and Reconstruction of High Frequencies for Band Limited Signals", Proc. 1st IEEE Benelux Workshop on Model based Processing and Coding of Audio (MPCA-2002), Nov. 15, 2002, 59-71.

(Continued)

*Primary Examiner* — Yogeshkumar Patel
(74) *Attorney, Agent, or Firm* — Womble Bond Dickinson (US) LLP

(57) ABSTRACT

An audio electronics system operates on audio data. A low-pass or bandpass filter produces first data from audio data. A level detector produces a time-varying first gain. The first gain is based on a time-varying level of the first data. A harmonics generator receives, as input, the first data adjusted by an inverse of the first gain. The harmonics generator produces second data, as harmonics of the input. A multiplier outputs the second data adjusted by the first gain. Other aspects are also described and claimed.

14 Claims, 15 Drawing Sheets

(56) References Cited

U.S. PATENT DOCUMENTS

2010/0158272 A1* 6/2010 Vickers ..... H04R 3/04 381/98
2010/0232629 A1 9/2010 Choi
2011/0091048 A1* 4/2011 Bai ..... G10H 1/0091 381/93
2011/0135115 A1* 6/2011 Choi ..... H04S 7/307 381/107
2012/0259626 A1* 10/2012 Li ..... H04R 1/1083 704/226
2013/0259238 A1* 10/2013 Xiang ..... G06F 3/017 381/17
2013/0259254 A1* 10/2013 Xiang ..... G10K 11/175 381/73.1
2014/0006017 A1* 1/2014 Sen ..... G10L 21/003 704/208
2014/0105419 A1* 4/2014 Vickers ..... H04R 3/04 381/104
2014/0341394 A1* 11/2014 Croft, III ..... H04R 1/2811 381/102
2015/0010170 A1* 1/2015 Lindahl ..... H03H 17/0261 381/119
2015/0092973 A1* 4/2015 Risberg ..... H04R 3/04 381/337
2015/0146890 A1* 5/2015 Yang ..... H04S 1/00 381/119
2016/0212533 A1* 7/2016 Risberg ..... H04R 3/04
2017/0134854 A1* 5/2017 Lindahl ..... H03H 17/0261
2018/0115824 A1* 4/2018 Cassidy ..... G10L 21/0232

OTHER PUBLICATIONS

Arora, Manish et al., "Low Complexity Virtual Bass Enhancement Algorithm for Portable Multimedia Device", AES 29th International Conference, Sep. 2, 2006, 1-4.

* cited by examiner

AUTOMATIC LEVEL CONTROL FOR PSYCHOACOUSTIC BASS ENHANCEMENT

An aspect of the disclosure here relates to an audio electronics system that processes audio data. Other aspects are also described.

BACKGROUND

In some electronic devices, including a smartphone, a tablet computer, and a laptop computer, it is not possible to use large speakers (such as those in dedicated, floor standing speaker cabinets) due to size and/or cost constraints. As these devices have become smaller in size with very limited space left for any individual component, the speakers have to be small as well. Therefore, small (micro) speakers having a diaphragm that is driven in the z-direction and whose largest dimension in the x-y plane is less than two inches for instance, are typically used for sound reproduction in these and most other small electronic devices. Nevertheless, it is also desirable to get high quality audio from these micro speakers, including a good bass response. However, small size and better audio quality are conflicting requirements, difficult and expensive to meet. It is a well-known characteristic of micro speakers to have poor low frequency response. For the speakers used in the devices mentioned above, the bass response is virtually nonexistent below 100 Hz. This frequency is even higher for even smaller devices such as smartwatches. As the human auditory system is logarithmic in nature, the low frequency (bass) range has a great impact on the overall quality of audio. Therefore, good bass reproduction is desirable.

SUMMARY

An audio electronics system that processes audio data, and related tangible computer-readable media and method are herein described, in which automatic level control is applied to the audio data for psychoacoustic bass enhancement.

In one aspect, the audio electronics system has a low pass or bandpass filter to produce first data from audio data. A level detector produces a time-varying first gain, based on a time-varying level of the first data. A harmonics generator receives as input the first data as adjusted by an inverse of the first gain. The harmonics generator produces second data, as harmonics of the input. A multiplier outputs the second data adjusted by the first gain.

In one aspect, a tangible, non-transitory, computer-readable media has instructions stored therein. When the instructions are executed by a processor, the processor performs a method. In the method, audio data is low-pass or bandpass filtered, to produce first data. A time-varying first gain is generated based on a time-varying level of the first data. The first data is multiplied by an inverse of the first gain, or divided by the first gain, to produce level controlled first data. Harmonics of the level controlled first data are generated, as second data. The second data is multiplied by the first gain value, to produce level controlled second data. The level controlled second data is output.

In one aspect, a method of processing audio data is performed by a processor-based system, and starts by filtering audio data, with a low-pass or bandpass filter, to produce first data. A time-varying first gain is determined, based on a time-varying level of the first data. Level controlled first data is determined as the first data multiplied by an inverse of the first gain or divided by the first gain. Second data is determined as harmonics of the level controlled first data. Level controlled second data is determined as the second data multiplied by the first gain. The level controlled second data is output.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Figure 1:
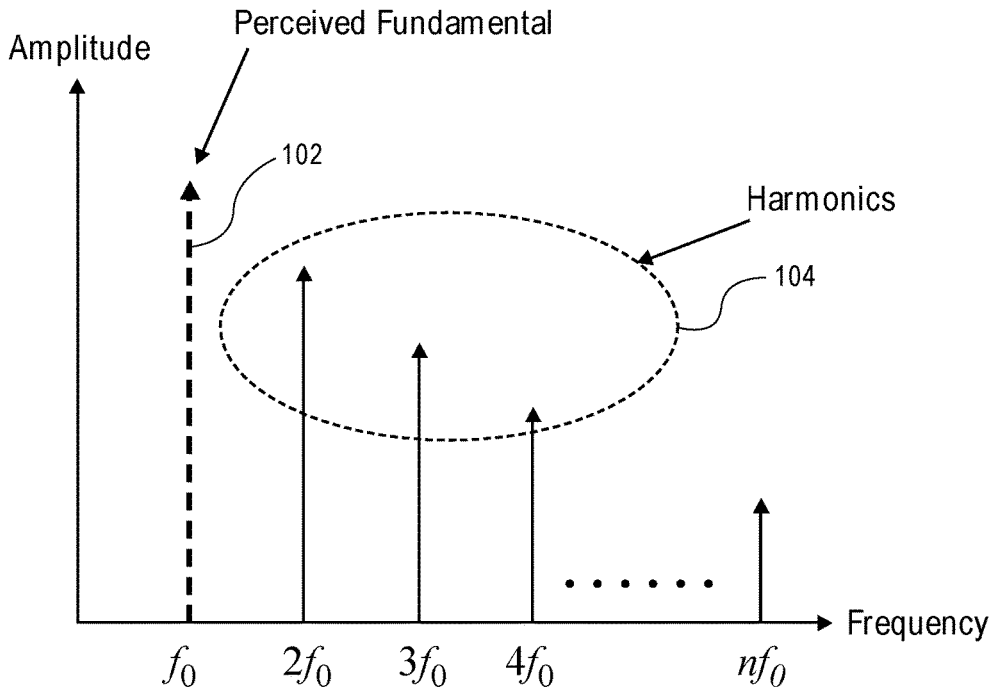
FIG. 1 depicts the missing fundamental effect.

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

The present disclosure highlights aspects of a psychoacoustic bass enhancement technique that may be implemented using digital audio processing techniques. The bass enhancement technique may be implemented as a processor executing software that, for example, is packaged as a plug-in to a computer's operating system and that can be used in any audio application program running on top of the operating system. The technique may be used to increase the perceived bass or low end that micro speakers (e.g., electrodynamic drivers whose voice coils have a maximum x-y plane dimension of less than two inches) found in small electronic devices have a hard time recreating. The method, in various aspects, leverages the psychoacoustic phenomenon of the missing fundamental, i.e., the perceived pitch of a series of harmonics is that of the fundamental frequency even when the fundamental is not physically present. For complex or broadband signals such as music, this effect is perceived as bass boost. A Non Linear Device (NLD) is typically used to generate the harmonic content.

NLDs are functions with nonlinear input-output characteristics. In a conventional system, however, NLDs with a quadratic or higher order polynomial element are unsuitable because the amount of nonlinearity they generate depends on the level of the input signal. This limitation severely restricts the possible choices for the NLD to those that are linear or quasi-linear in amplitude, i.e., the device's operation does not depend on the input amplitude, or level. This includes piecewise linear NLDs like half-wave rectifiers, full-wave rectifiers, integrators, etc. and linear combinations of these. These NLDs however performed poorly during testing and exhibited strong intermodulation distortion, whereas well-designed continuous nonlinear functions such as hyperbolic tangent (soft clipper) and exponential performed significantly better. The system described here mitigates this and other issues by combining the structure of what may be any suitable psychoacoustic bass enhancement subsystem with an Automatic Level Control feature. This feature was found to be useful as it enabled the exploration and use of an entire family of NLDs that were previously unsuitable in a conventional system. As a result, the system could be tuned for better audio quality while suppressing unpleasant artifacts. In this disclosure an example psychoacoustic bass enhancement subsystem is introduced followed by aspects of the Automatic Level Control feature in some detail.

Improved bass response may be achieved by a totally new speaker design, however this is typically expensive, requires years of R&D, and may only result in a small improvement. A more cost-effective solution is to use signal processing to improve bass perception by mapping the low frequencies onto higher octaves. This is typically done by leveraging the psychoacoustic phenomenon of the missing fundamental.

FIG. 1 is used to illustrate the missing fundamental effect. This phenomenon is an auditory illusion whereby humans perceive the "lowest" fundamental pitch 102 when soundwaves are excited by a series of harmonics 104 even if the fundamental is not physically present (hence the dotted line representation.) For complex tones and broadband signals such as music or speech, this is perceived as richer bass or low end, i.e., bass enhancement.

A Non Linear Device (NLD) implemented in software is a function with nonlinear input-output characteristics. These may include piecewise linear functions such as half-wave rectifier, full-wave rectifier and full-wave integrator, or any continuous nonlinear function including quadratic and higher-order polynomials, hyperbolic tangent (soft clipper), exponential, etc.

Figure 2:
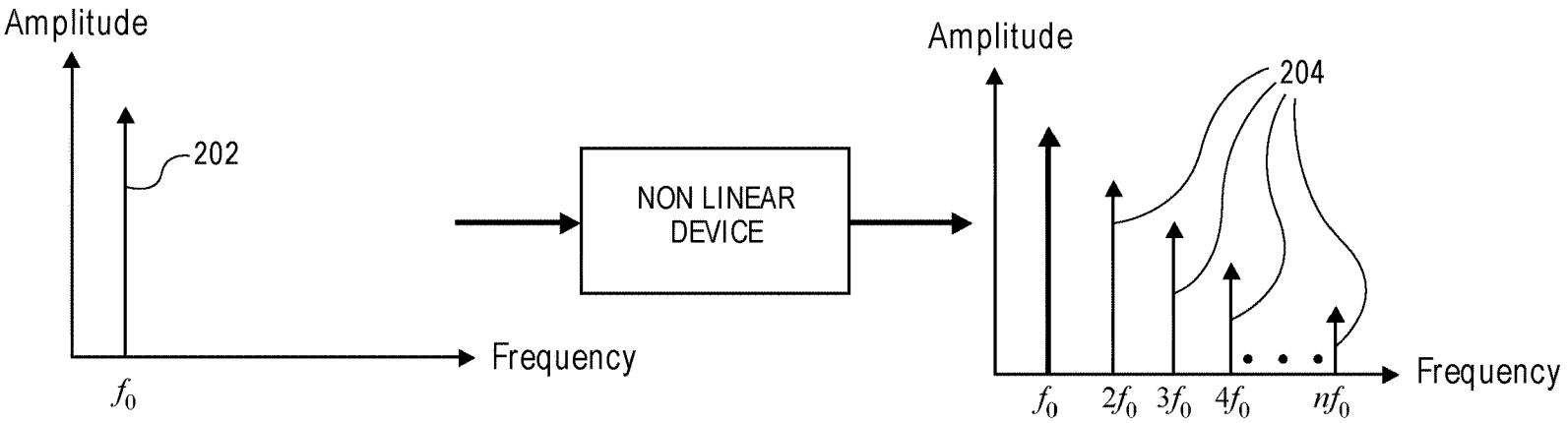
FIG. 2 depicts nonlinear device output for a single sinusoidal input.

FIG. 2 depicts nonlinear device output for a single sinusoidal input. A pure tone (sine wave) passing through an NLD gets distorted nonlinearly generating a number of odd and/or even harmonics. The pitch of the input signal 202 is preserved, as the higher frequency components in the output of the NLD are harmonics 204 of the original low frequency components. NLDs are easy to implement in the time domain and computationally inexpensive. However, intermodulation distortion is a common problem while using NLDs with broadband signals. These are additional components at the output of the NLD which are usually formed by combining two or more adjacent harmonics. As these are not harmonically related to the original components, these tend to distort the perceived bass in an unpleasant way.

Figure 3:
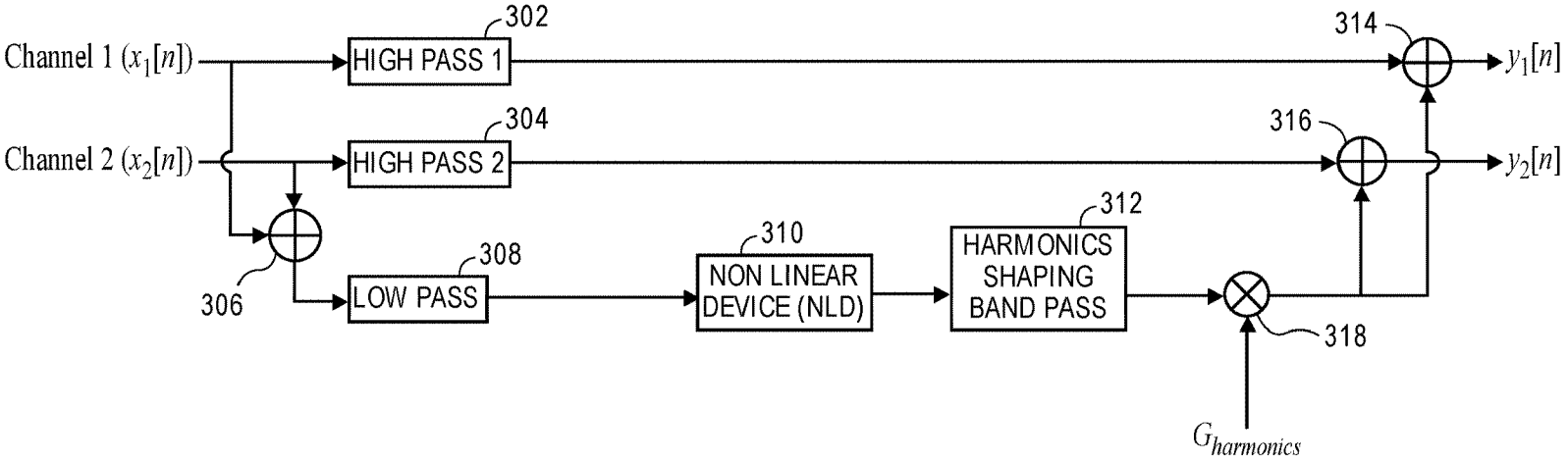
FIG. 3 depicts a psychoacoustic bass enhancement system.

FIG. 3 depicts a conventional psychoacoustic bass enhancement system. In order to mitigate the intermodulation distortion as well as to apply the nonlinearity due to the NLD in a controlled manner, a typical psychoacoustic bass enhancement system, as seen in FIG. 3, is composed of an NLD that is wrapped inside a filter skeleton. First, the frequency range that the speaker is able to sufficiently reproduce is extracted using high pass filters 302, 304 (High Pass 1 302 and High Pass 2 304) and sent through the processing chain unaltered. The input is mono-summed by a summer 306, and the low frequency range that the speaker is not able to recreate (typically 0-200 Hz) is extracted by a low-pass filter 308 and sent to a Non Linear Device (NLD) 310 that generates the harmonic content. The raw harmonics generated by NLD 310 are filtered for the desired range (typically 100-400 Hz) using a harmonics shaping band pass filter 312. The filtered harmonic content is called virtual bass as it provides the effect of improved bass perception even though the low frequency range is not actually being reproduced by the speaker. The virtual bass signal is then adjusted through multiplication by a harmonics gain 318 and combined through summers 314, 316 with the high-passed signal to produce the final output. In this particular example, the original low frequency content (original bass) is ignored. However, it may also be blended with the virtual bass and added to the high-passed signal, e.g., through summers 314, 316. Similar aspects apply to variations of the systems described herein.

One of the limitations of the standard/conventional system discussed above is that NLDs with a quadratic or higher-order input-output characteristic are basically unsuitable because the amount of nonlinearity they generate depends on the level of the input signal. This not only includes polynomials but also any nonlinear function whose Taylor series expansion results in a quadratic or higher-order polynomial such as hyperbolic tangent (soft clipper), exponentials, etc. If such an NLD is used, an audio track sent to the system at different levels will generate different harmonic content. This makes the perceived bass effect dependent on the input level (volume) which is not acceptable. Moreover, even during the length of a single track transient bass events such as kick drums tend to exhibit a larger level than other more persistent bass sounds. Therefore, conventional systems tend to enhance the bass unevenly through the audio track if the NLD is not chosen correctly.

This limitation severely restricts the possible choices for NLD to those that are linear or quasi-linear in amplitude, i.e., the device's operation does not depend on the input amplitude, or level. This includes piecewise linear NLDs like half-wave rectifiers, full-wave rectifiers, integrators, etc. and linear combinations of these. Unfortunately, these NLDs exhibit strong intermodulation distortion, whereas well-designed continuous nonlinear functions such as hyperbolic tangent (soft clipper) and exponential have better performance. Therefore, it is necessary to find a solution that allow use of these NLDs effectively so that the generated harmonic content for any given track stays consistent regardless of the level at which it is fed to the system.

Figure 4:
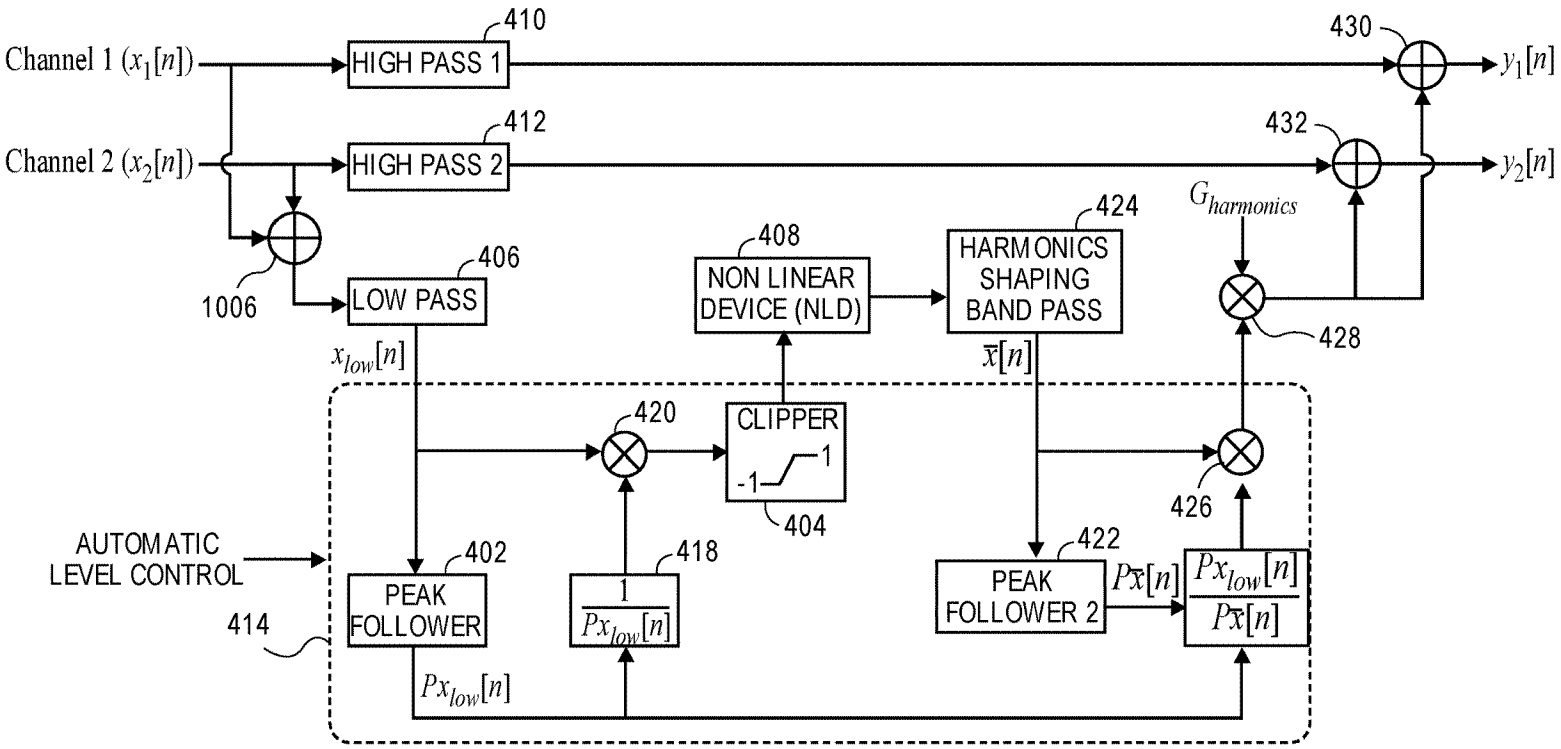
FIG. 4 depicts a psychoacoustic bass enhancement system with automatic level control.

FIG. 4 depicts a psychoacoustic bass enhancement system with automatic level control, in one aspect. The system that is developed herein mitigates the above and other issues by combining the structure of a conventional psychoacoustic bass enhancement system with an Automatic Level Control feature. FIG. 4 is a block diagram that highlights certain hardware components and functionality. Variations and further aspects are provided in FIGS. 9 and 10.

Some interesting aspects of this feature are the Peak Followers 402, 422 that are designed to constantly monitor the local level of the low frequency signal, $x_{low}[n]$, at the output of the Low Pass filter 406, and that of the generated harmonic content, $\bar{x}[n]$, at the output of the Harmonics Shaping Band Pass filter. The first Peak Follower 402 output, $p_{x_{low}}[n]$, is used to normalize the level of the signal being sent to the NLD 408. This is to ensure that the harmonic content generated by the NLD 408 remains consistent for a given audio track regardless of its input level to the system. The second Peak Follower 422 output, $p_{\bar{x}}[n]$, is combined with the first to match the level of the generated harmonic content to that of the low frequency (original bass) signal. This ensures that the perceived bass is somewhat proportional to the original bass in terms of its loudness.

Below, the operation of the Peak Follower 402, 422 is discussed, followed by a brief description of how it is used in level normalization and level matching. In one example, high pass filters 410, 412, summers 416, 430, 432, multipliers 420, 426, 428, clipper 404, harmonics shaping band pass filter 424 and aspects of automatic level control 414 including gains and inverse gain 418 are discussed with reference to related components in FIGS. 9 and 10.

Figure 5A:
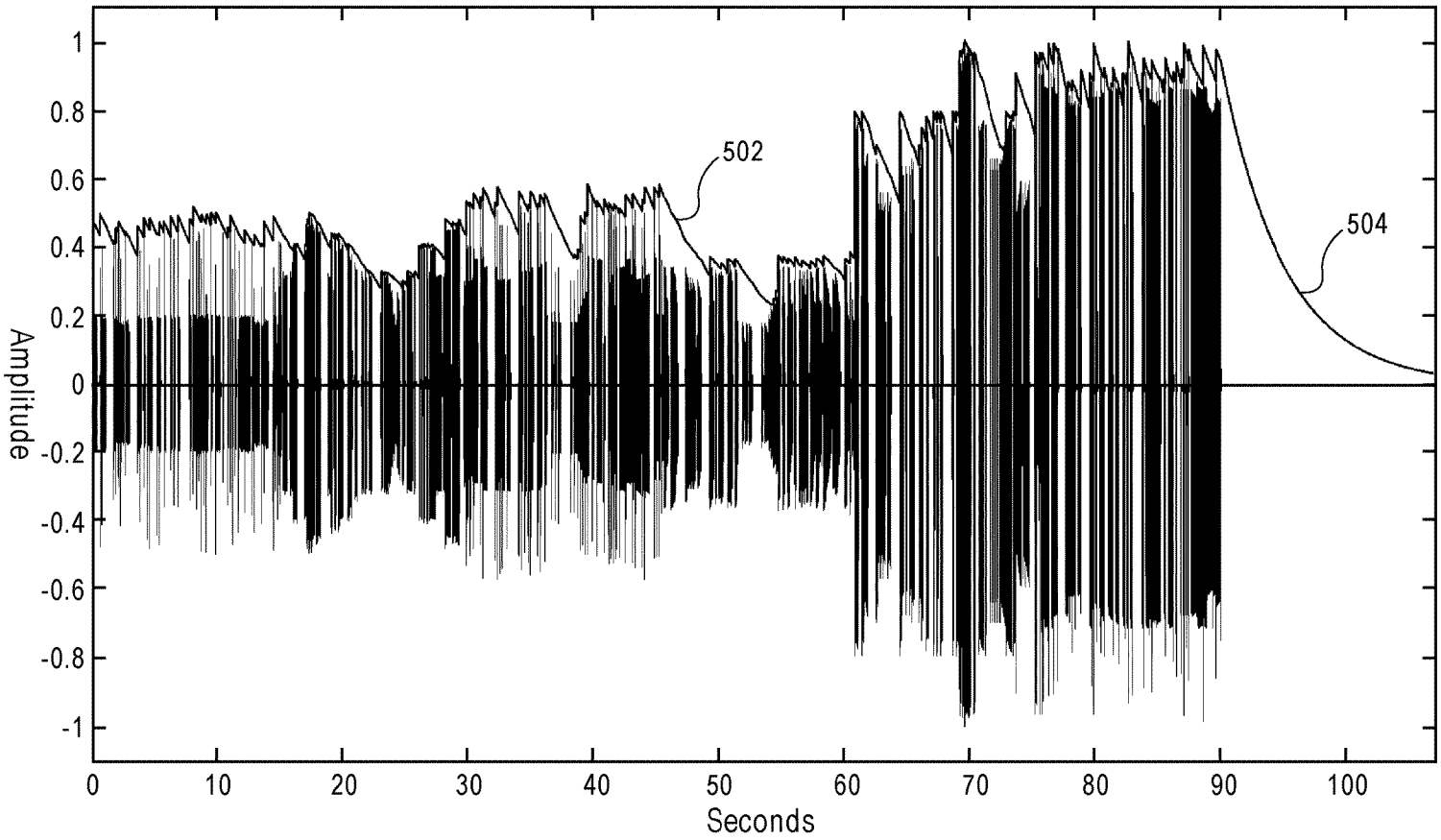
FIG. 5A depicts level tracking using one example of a peak follower, with a release time constant of about five seconds.

FIG. 5 depicts level tracking using an example peak follower with a release time constant of about five seconds. In one aspect, the Peak Follower may be a single pole smoothing filter that has a fast attack time and a slow release time. Let n be the sample index, $t_a$ the attack time constant, $t_r$ the release time constant, and $F_s$ the sampling rate. For the $n^{th}$ input sample x[n], the Peak Follower output 502 may be defined as, $$P[n]=\alpha P[n-1]+(1-\alpha)|x[n]| \tag{1}$$

where, $$\alpha = e^{\frac{-1}{t_a F_s}} \text{ if } |x[n]| > P[n-1],$$

else $$\alpha = e^{\frac{-1}{t_r F_s}}.$$

it the attack time constant, $t_a$, is close to zero (≈0), P[n] will instantaneously track any increase in the input amplitude, |x[n]|, however, any decrease in the input amplitude will be tracked very slowly if the release time is sufficiently slow. Therefore, P[n] hovers more-or-less around the "local level" of the input if the release time is chosen correctly (ref. FIG. 5). Unfortunately, this simple peak following algorithm tends to require a long release time constant ($t_r$≈5s) in order to provide a good level estimate of the input signal. This results in a delayed response if the input level drops suddenly as seen by the long release tail 504 at the end of the signal in FIG. 5. Moreover, the level estimate also tends to be very rough which is not desirable as it may introduce unwanted harmonic distortion.

The peak follower developed in one aspect has been modified to be smoother and have a faster decay without sacrificing level tracking performance. This is done by introducing a hold stage, in addition to the usual attack and release stages, in the basic Peak Follower algorithm, and then smoothing the rough output for an overall smooth estimate.

Figure 5B:
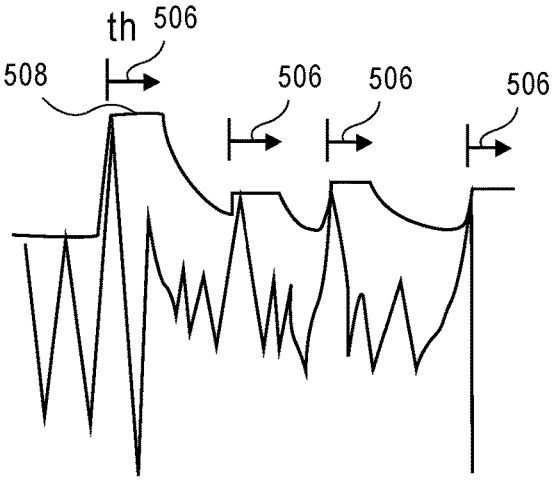
FIG. 5B depicts level tracking using a hold time 506.

FIG. 5B depicts level tracking using a hold time 506. The hold stage activates after the attack stage if the input amplitude drops below the current peak value 508. During the hold stage, the peak value 508 is maintained at its current value until the hold time 506, $t_h$, has elapsed. The time elapsed during the hold stage is reset to zero if the input amplitude, |x[n]|, gets close to the current peak value 508 by more than a factor of γ. The algorithm is described by the pseudo code below.

Figure 6:
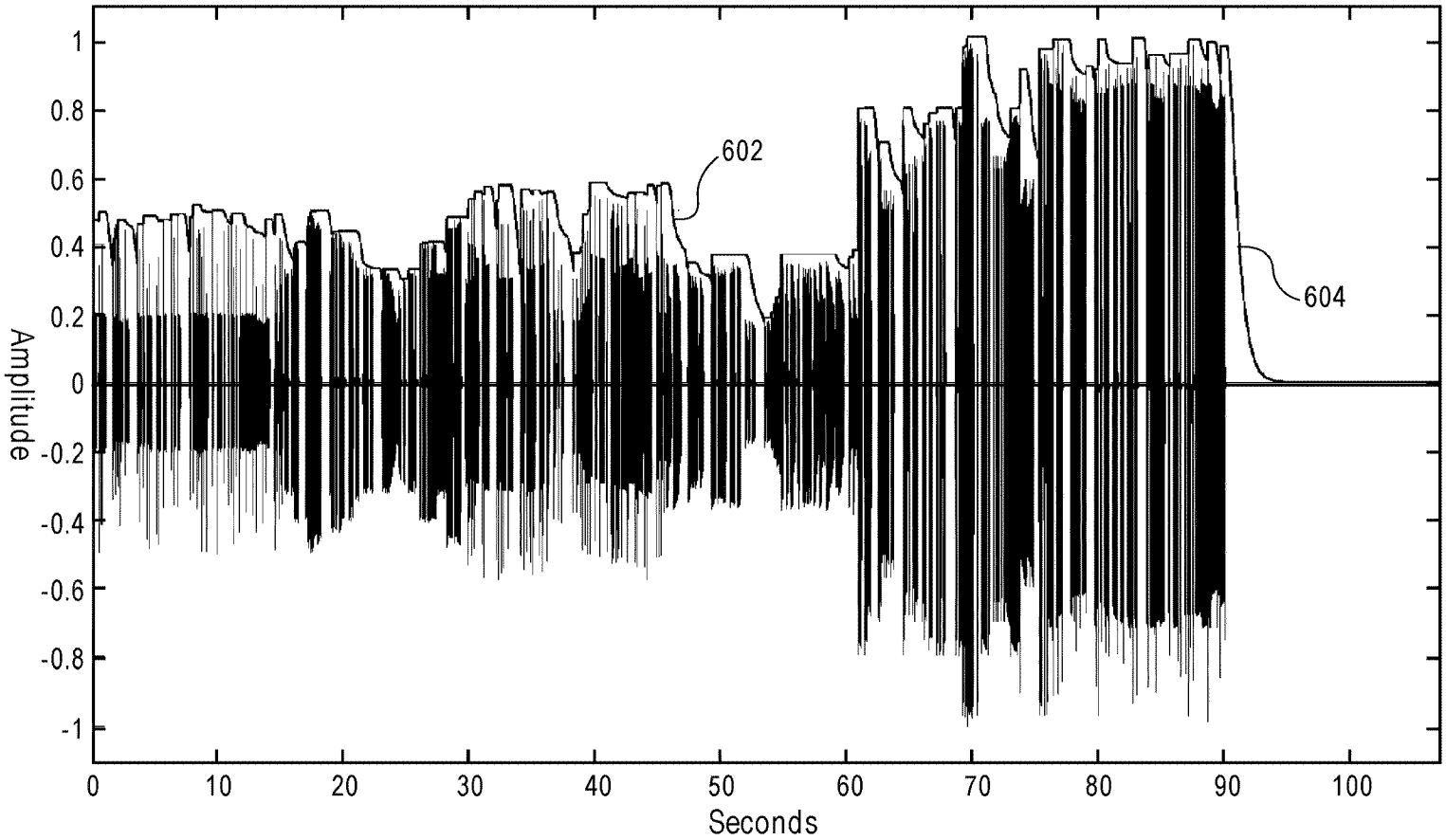
FIG. 6 depicts level tracking using one example of a modified peak follower, with hold and release times of about 0.5 second.

FIG. 6 depicts level tracking using a modified peak follower with hold and release times of about 0.5 second.

1: function PEAKFOLLOWER(x[n], $F_s$, $t_a$, $t_r$, $t_h$, $t_s$)
2: $\alpha \leftarrow e^{-1/(t_r F_s)}$ Default Release Stage
3: $\alpha_s \leftarrow e^{-1/(t_s F_s)}$ ⊳ $t_s$ is the smoothing time constant
4: if |x[n]|>P[n−1] then ⊳ Attack Stage
5: $\alpha \leftarrow e^{-1/(t_a F_s)}$
6: k←0 ⊳ Reset hold time
7: if P[n−1]>$P_s$[n−1] then
8: $\alpha_s \leftarrow e^{-1/(t_a F_s)}$
9: else if |x[n]|<P[n−1] and k<$t_h$ $F_s$ then ⊳ Hold Stage
10: α←1
11: k←k+1 ⊳ Increment hold time
12: if |x[n]|>=γP[n−1] then ⊳ Hold reset condition
13: k←0
14: P[n]←αP[n−1]+(1−α)|x[n]| ⊳ Rough estimate
15: $P_s$[n]←$\alpha_s P_s$[n−1]+(1−$\alpha_s$) P[n] ⊳ Smooth estimate
16: return $P_s$[n]

The output 602 of the modified Peak Follower algorithm for the signal in FIG. 5 is shown in FIG. 6. With the proposed method, the release time can be reduced by more than a factor of 10, down to only 0.5 s. The hold time was also set at 0.5 s. Comparing FIGS. 5 and 6, it is clear that the modified algorithm produces a smoother estimate of the "local level" of the signal and also decays faster as evidenced by the short release tail 604 at the end.

Figure 7:
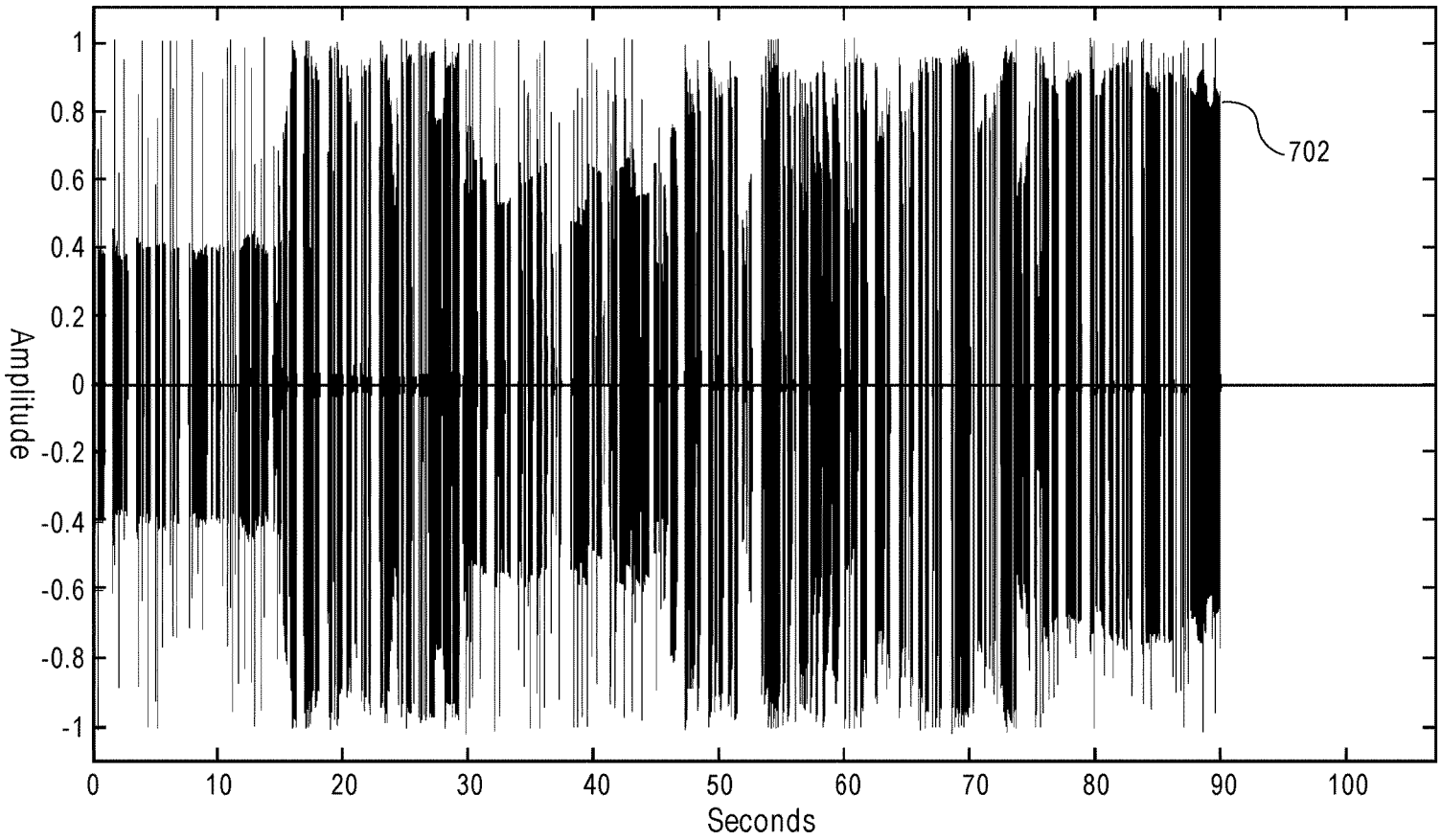
FIG. 7 depicts the signal shown in FIG. 6 level-normalized using a technique described herein before being processed by the NLD.

As discussed above, the Peak Follower can be used to estimate the local level of a signal if the attack, release and hold time constants are set appropriately. The level estimate of the output from the Low Pass filter in FIG. 4, $p_{x_{low}}[n]$, is used to normalize the level of the input being sent to the NLD. This may be done by dividing the low end signal, $x_{low}[n]$, by its level estimate, $p_{x_{low}}[n]$. In practice a lower bound should be applied to $p_{x_{low}}[n]$ to avoid amplifying noise, getting NaNs (not a number) or infinite values. If the attack is instantaneous, we know that $p_{x_{low}}[n]>|x_{low}[n]|$ for all n, which implies $$\frac{|x_{low}[n]|}{p_{x_{low}}[n]} \le 1 \forall n,$$

i.e., the signal is bounded by 1 (see FIG. 7). A Clipper may also be added right before the NLD to clip any pathological peaks between −1 and 1 in the event that the attack time is not instantaneous.

FIG. 7 depicts the signal shown in FIG. 6 level-normalized using a technique described herein before being processed by the NLD. As seen in the figure, the level-normalized signal 702 is within −1 and 1 throughout its duration. Normalizing the input to the NLD ensures that the harmonic content at the output of the NLD remains more-or-less the same for a given track regardless of the level at which it is fed to the system. This idea lets designers use and explore the performance of an entire family of NLDs that were previously unsuitable in the conventional system. Moreover, level-normalizing the input to the NLD also has the added advantage of evenly applying the nonlinear distortion throughout the length of a single track. This is useful because there may be large level variations between different bass sounds within a single track. A piano solo, for example, will likely exhibit a lower level than a typical kick drum. If the input to the NLD is normalized by using its local level estimate, the perceived bass effect will work for bass sounds appearing at different levels even within a single track. This noticeably improves the overall audio quality.

Figure 8:
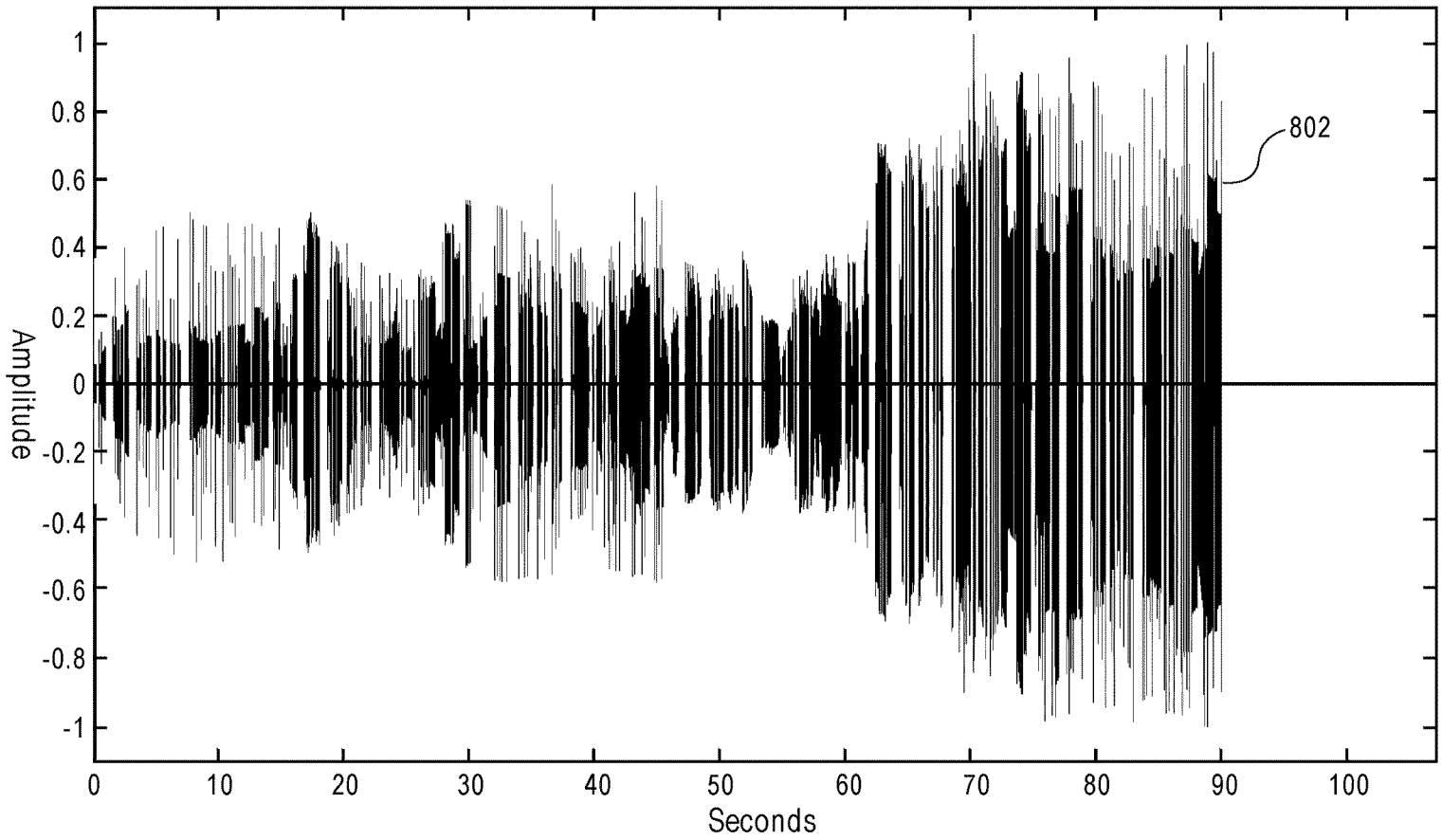
FIG. 8 depicts the output harmonic content (virtual bass) that has been level matched with the low frequency (original bass) signal shown in FIG. 6 using the technique described herein.

FIG. 8 depicts the output harmonic content 802 (virtual bass) that has been level matched with the low frequency (original bass) signal shown in FIG. 6 using the technique described herein.

Figure 10:
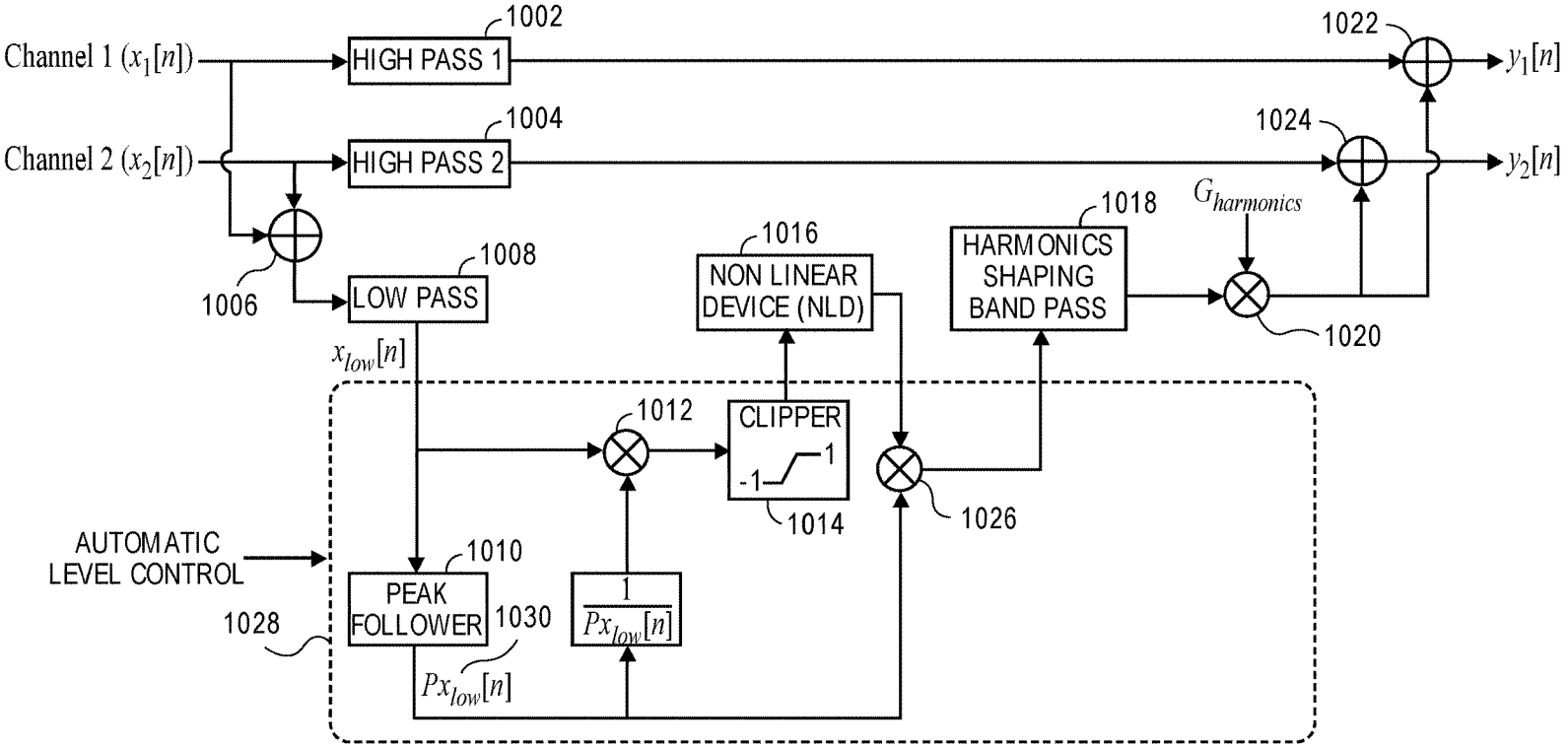
FIG. 10 depicts another psychoacoustic bass enhancement system with automatic level control.

The harmonic content generated by the NLD from the normalized input could be at any level (not necessarily normalized) depending on the NLD used. Moreover, the signal envelope at the output of the NLD will be distorted due to the normalization. This is not desirable in the final output. One possible solution would be to invert the gain applied to normalize the low frequency signal and then apply it to the NLD's output. This design is shown in FIG. 10. However, this will only restore the signal envelope but not address the first problem of a potentially significant level difference between the harmonic content and the original low frequency (bass) content. This may be solved by using a second Peak Follower 422 that monitors the level of the harmonic content at the output of the harmonics shaping band pass filter 424 in order to re-normalize it before applying the inverse gain to restore the signal envelope. As seen in FIG. 4, this is achieved by multiplying the output from the Harmonics Shaping Band Pass filter 424, by $$\frac{p_{x_{low}}[n]}{p_{\bar{x}}[n]}.$$

The division by denominator $p_{\bar{x}}[n]$normalizes the signal $\bar{x}[n]$, and multiplying by $p_{x_{low}}[n]$ brings the level to that of the original bass, $x_{low}[n]$. By comparing FIG. 6 to FIG. 8, it is clear that the two signals have a similar profile in terms of envelope and level.

Figure 9A:
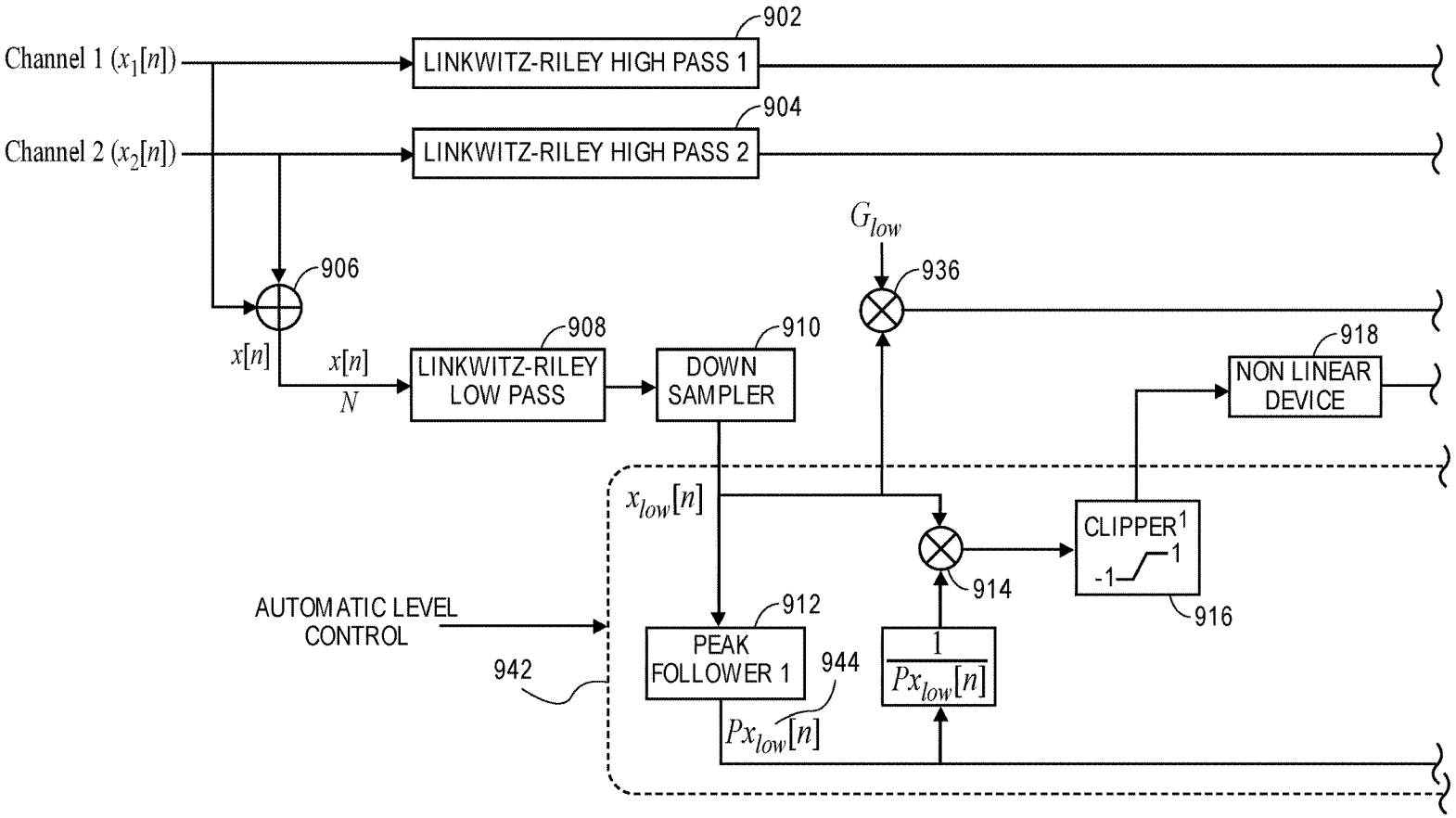
FIGS. 9*a*-9*b* depict a further psychoacoustic bass enhancement system with automatic level control, in one aspect.
Figure 9B:
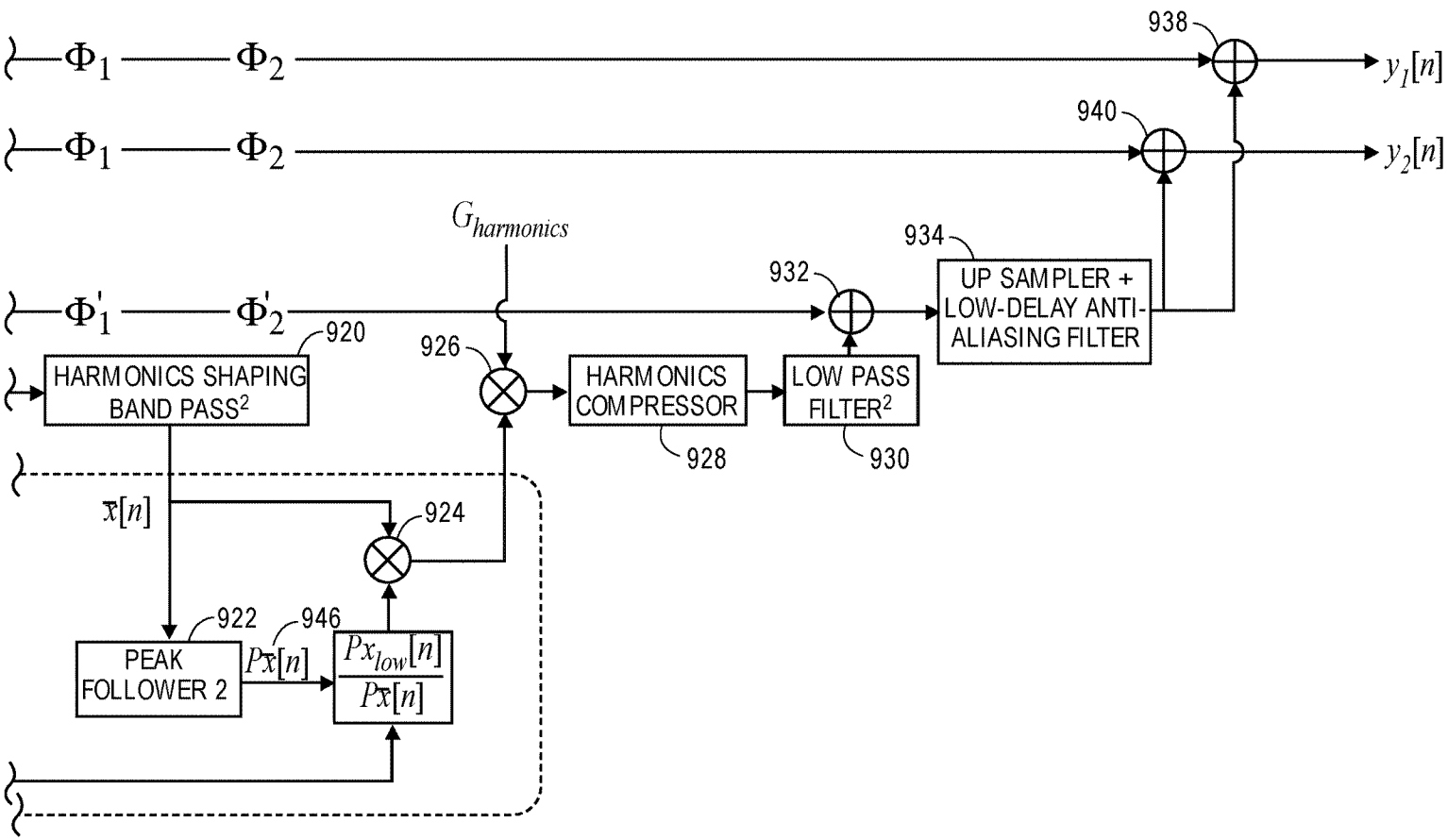

FIGS. 9*a*-9*b* depict a further psychoacoustic bass enhancement system with automatic level control, in one aspect. The basic architecture of the system developed here was discussed above with emphasis on the Automatic Level Control feature. However, in various aspects in various combinations, the system in FIGS. 9*a*-9*b* includes phase compensation filters to avoid spectral nulls while summing signals arriving from different paths, a sample rate converter to reduce computational load, a Harmonics Compressor in order to rein in any pathological peaks in the harmonic content, and it also blends the low frequency (original bass) signal with the virtual bass before summing with the high passed signal. Variations can be constructed for more audio channels, monophonic audio, or psychoacoustic bass enhancement dedicated to each audio channel, and fewer or more features than shown here.

Following audio data from left to right in FIG. 9*a* and then continuing to FIG. 9*b*, a high pass filter 902, in the aspect shown here a Linkwitz-Riley high pass filter labeled "1", receives first channel audio data and produces high pass filtered first channel audio data. A high pass filter 904, in the aspect shown here a Linkwitz-Riley high pass filter labeled "2", receives second channel audio data and produces high pass filtered second channel audio data. A summer 906 adds the first channel audio data and the second channel audio data, and produces audio data, which could be considered monophonic or summed audio data. Low-pass filter 908, in the aspect shown here a Linkwitz-Riley low-pass filter but could alternatively be a bandpass filter tuned to pass low audio frequencies (e.g., bass), produces filtered audio data (or just audio data) for the automatic level control 942 shown in dashed outline. A down sampler 910 down samples the output of the low-pass filter 908, and produces down sampled low-pass filtered audio data, or just filtered audio data (bass audio), for the automatic level control 942.

In the automatic level control 942, a level detector, in one aspect the Peak Follower 912 labeled "1", produces a time-varying gain value 944, which could be termed a first gain value, based on the time-varying level of the filtered audio data (bass audio). Other types of level detectors could be used in the system, such as an envelope follower, or an RMS (root mean square) detector. Generally, the greater the amplitude of the signal represented in the audio data, the greater should be the gain value 944, and the lesser the amplitude of the signal, the lesser should be the gain value 944. A multiplier 914 multiplies the filtered audio data from the low-pass filter 908 (and down sampler 910, in one aspect) by the inverse of the gain value 944 determined by the level detector, Peak Follower 912 labeled "1". Equivalently, the filtered audio data could be divided by the gain value 944. The filtered audio data becomes level-normalized after being adjusted by the inverse gain. Other mechanisms for adjusting the filtered audio data by the inverse of the gain value 944 could be devised.

A harmonics generator, in one aspect the nonlinear device 918, receives the filtered audio data adjusted by the inverse of the gain value 944, directly, or in one aspect shown in FIG. 9*a* with any pathological peaks clipped by a clipper 916. The harmonics generator produces harmonics of the inverse gain-adjusted filtered audio data, which could be termed second data or harmonics. This second data or harmonics is input to a harmonics shaping band pass filter 920 (FIG. 9*b*), which adjusts or shapes the second data (harmonics). The harmonics shaping band pass filter 920 is adjusting the 'shape' of the second data as observed in the frequency domain. The raw harmonics from the NLD are limited to the desired band (typically within 100-400 Hz) by using this filter. The magnitude response of the filter being used consequently 'shapes' the harmonics in the frequency domain.

Another level detector, in one aspect the Peak Follower 922 labeled "2", produces a time-varying gain value 946, which could be termed a second-varying gain value, based on the time-varying level of the band passed second data (harmonics). A multiplier 924 multiplies the band passed second data (harmonics) by the first gain value 944 divided by the second gain value 946, producing level adjusted shaped harmonics as the digital audio output of the automatic level control 942. Equivalent operations could be performed in variations, such as multiplying by the inverse of the second gain value 946, multiplying and later dividing, dividing first and then multiplying, etc. this step is done to level match the shape-harmonics to the original bass audio.

After the automatic level control 942, a multiplier 926 multiplies a harmonics gain value $G_{harmonics}$ by the level adjusted shaped harmonics, or second data adjusted by the first gain value 944 divided by the second gain value 946, producing harmonics gain value adjusted harmonics. Here, too, equivalent operations could be performed, such as combining the harmonics gain value, the first gain value 944 and/or the second gain value 946 prior to performing a multiplication of the band passed second data. A harmonics compressor 928 operates on the harmonics gain value adjusted harmonics, and passes the output to a low-pass filter 930. In one aspect, the phase compensator pair of the low-pass end of an $N^{th}$Nth order harmonics shaping bandpass filter is placed after the harmonics compressor 928 to capture residual harmonics. A multiplier 936 multiplies the output of the down sampler 910 and a low-frequency, or low-end blend, gain $G_{low}$, and sends output to all pass filters, then to a summer 932. The summer 932 adds the all pass filtered, low-frequency gain adjusted, down sampled low-passed audio and the output of the low-pass filter 930, which is the filtered, gain adjusted compressed harmonics, and sends output to an up sampler with low-delay anti-aliasing filter 934 for up sampling. The up sampled resultant audio data is added in summers 938, 940 to the high pass filtered first channel audio data and high pass filtered second channel audio data respectively, each having run through all pass filters to compensate for high and low pass ends of the harmonics bandpass, producing psychoacoustic bass enhanced first and second channel audio data.

FIG. 10 depicts a still further psychoacoustic bass enhancement system with automatic level control, in one aspect. This design includes Level Normalization but does not include Level Matching. Other systems, including those depicted in FIGS. 4 and 9, can be designed using the system shown in FIG. 10 as a foundation. Variations can be constructed for more audio channels, monophonic audio, or psychoacoustic bass enhancement dedicated to each audio channel, or fewer or more features than shown here. Some versions use a digital signal processor (DSP) or other processor for digital signal processing. Where components, such as a summer, a multiplier, a filter, a generator, a follower, a clipper, etc., are described, it should be appreciated that these can be implemented using software and hardware functionality of a processor, or dedicated hardware, firmware or combination thereof and that mathematically equivalent operations or functions could also be used, as could further processed or combined versions of signals and data. Following audio data from left to right in FIG. 10, a high pass filter 1002, High Pass 1, receives first channel audio data and produces high pass filtered first channel audio data. A high pass filter 1004, High Pass 2, receives second channel audio data and produces high pass filtered second channel audio data. A summer 1006 adds the first channel audio data and the second channel audio data, and produces audio data, which could be considered monophonic or summed audio data. Low-pass filter 1008, which could alternatively be a bandpass filter tuned to pass low audio frequencies (e.g., bass), produces filtered audio data (or just audio data) for the automatic level control 1028 shown in dashed outline.

In the automatic level control 1028, a level detector, in one aspect the Peak Follower 1010, produces a time-varying gain value 1030 based on the time-varying level of the filtered audio data (bass audio). Other types of level detectors could be used in the system, such as an envelope follower, or an RMS (root mean square) detector. Generally, the greater the amplitude of the signal represented in the audio data, the greater should be the gain value 1030, and the lesser the amplitude of the signal, the lesser should be the gain value 1030. A multiplier 1012 multiplies the filtered audio data from the low-pass filter 1008 by the inverse of the gain value 1030 determined by the level detector, Peak Follower 1010. Equivalently, the filtered audio data could be divided by the gain value 1030. Other mechanisms for adjusting the filtered audio data by the inverse of the gain value 1030 could be devised. A harmonics generator, in one aspect the nonlinear device 1016 receives the filtered audio data adjusted by the inverse of the gain value 1030, directly, or in one aspect shown in FIG. 10 with any pathological peaks clipped by a clipper 1014. The harmonics generator produces harmonics of the inverse gain-adjusted filtered audio data, which could be termed second data or harmonics. A multiplier 1026 multiplies the harmonics, i.e., the second data, by the gain value 1030, producing second data (i.e., the harmonics) adjusted by the gain value 1030. These harmonics or second data adjusted by the gain value are output by the automatic level control 1028 as a digital audio output. In some variations, a further processed version of the second data adjusted by the gain value 1030 could be output as a digital audio output.

After the automatic level control 1028, the digital audio output of the automatic level control 1028 is input to a harmonics shaping bandpass filter 1018, which adjusts or shapes the second data (harmonics) adjusted by the gain value 1030. The harmonics shaping bandpass filter 1018 thus produces a further processed version of the second data adjusted by the gain value 1030. A multiplier 1020 multiplies a harmonics gain value $G_{harmonics}$ by the harmonics shaping bandpass filtered version of the second data adjusted by the gain value 1030, and produces a yet further processed version of the second data (harmonics) adjusted by the gain value 1030. Summers 1022, 1024 add this yet further processed version, from the harmonics shaping bandpass filter 1018 multiplied by the harmonics gain value, to the high pass filtered first channel audio data and high pass filtered second channel audio data respectively. This produces psychoacoustic bass enhanced first and second channel audio data.

Figure 11:
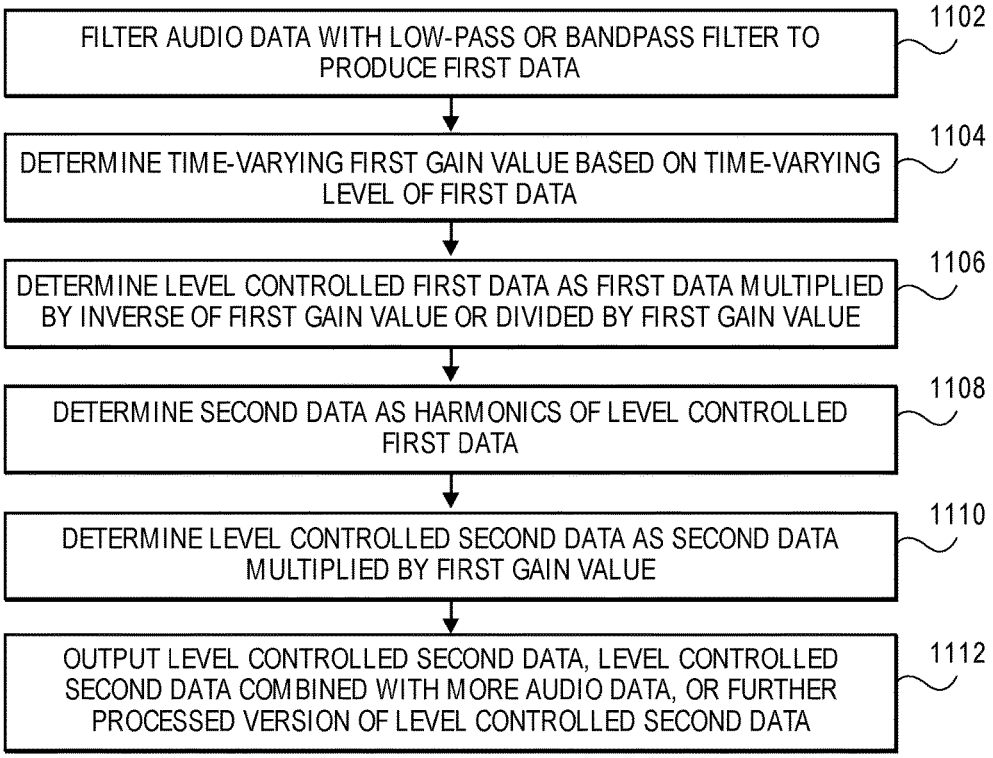
FIG. 11 is a flow diagram of a method of processing audio data.

FIG. 11 is a flow diagram of a method of processing audio data. The method can be performed by psychoacoustic bass enhancement systems such as shown in FIGS. 4, 9 and 10, and variations thereof.

In an action 1102, audio data is filtered with a low-pass or bandpass filter, to produce first data.

In an action 1104, a time-varying first gain value is determined, based on the time-varying level of the first data. For example, the first gain value could be determined by a peak follower, an envelope detector or an RMS detector.

In an action 1106, level controlled first data is determined as first data multiplied by the inverse of the first gain value, or divided by the first gain value. For one aspect, the level controlled first data has one or more peaks removed by a clipper.

In an action 1108, second data is determined as harmonics of the level controlled first data. For example, the second data could be directly from a harmonics generator or nonlinear device, or could be that shaped by a harmonics shaping bandpass filter.

In an action 1110, level controlled second data is determined as second data multiplied by the first gain value.

In an action 1112, the system outputs level controlled second data, level controlled second data combined with more audio data, or further processed version of level controlled second data.

Figure 12:
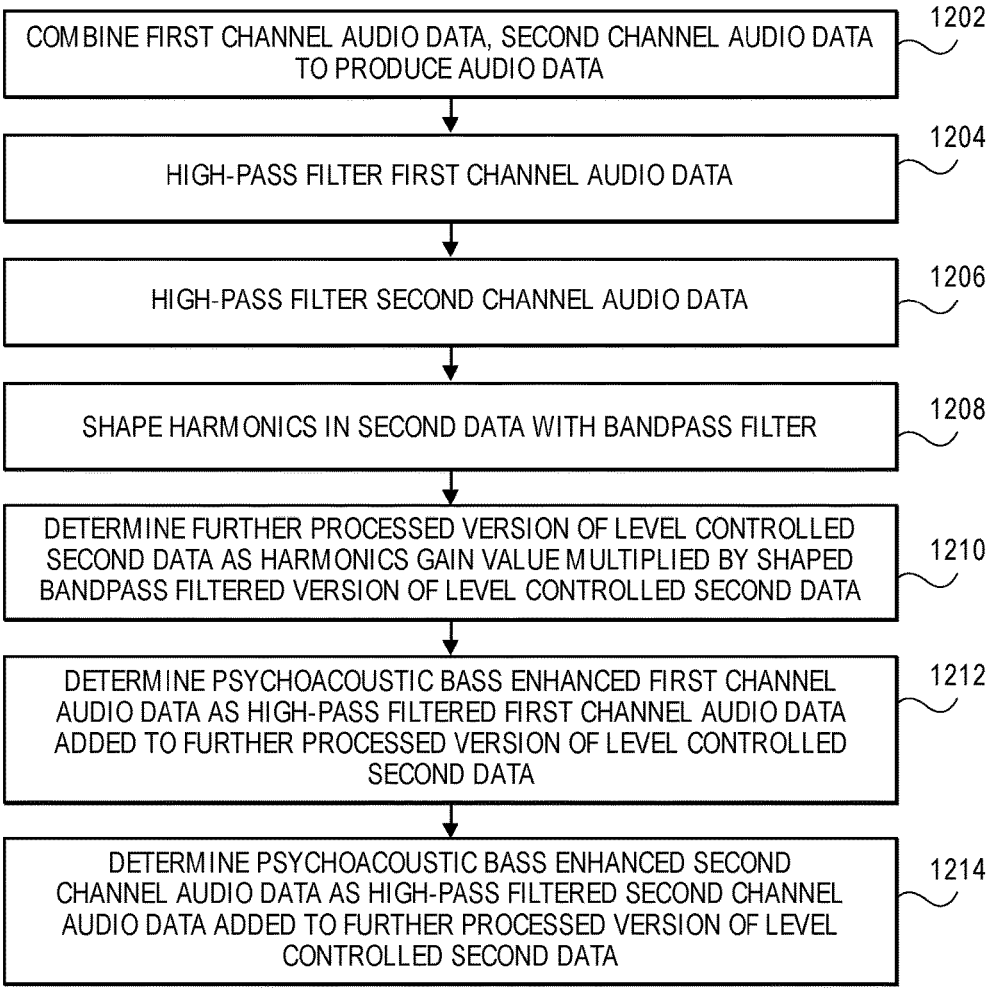
FIG. 12 is a flow diagram of a further method of processing audio data.

FIG. 12 is a flow diagram of a further method of processing audio data. This flow diagram adds further actions to the flow diagram of FIG. 11, and the combined method can be practiced by psychoacoustic bass enhancement systems shown in FIGS. 4, 9 and 10, and variations thereof.

In an action 1202, first channel audio data and second channel audio data are combined to produce audio data.

In an action 1204, the first channel audio data is high pass filtered.

In an action 1206, the second channel audio data is high pass filtered.

In action 1208, the harmonics in second data are shaped with a bandpass filter. This references action 1108 of the flow diagram of FIG. 11.

In an action 1210, a further processed version of level controlled second data is determined as a harmonics gain value multiplied by the shaped bandpass filtered version of the level controlled second data. This references action 1110 of the flow diagram of FIG. 11, using the shaped harmonics of action 1208 as the second data.

In an action 1212, psychoacoustic bass enhanced first channel audio data is determined as high pass filtered first channel audio data added to the further processed version of level controlled second data.

In an action 1214, psychoacoustic bass enhanced second channel audio data is determined as high pass filtered second channel audio data added to the further processed version of level controlled second data.

Figure 13:
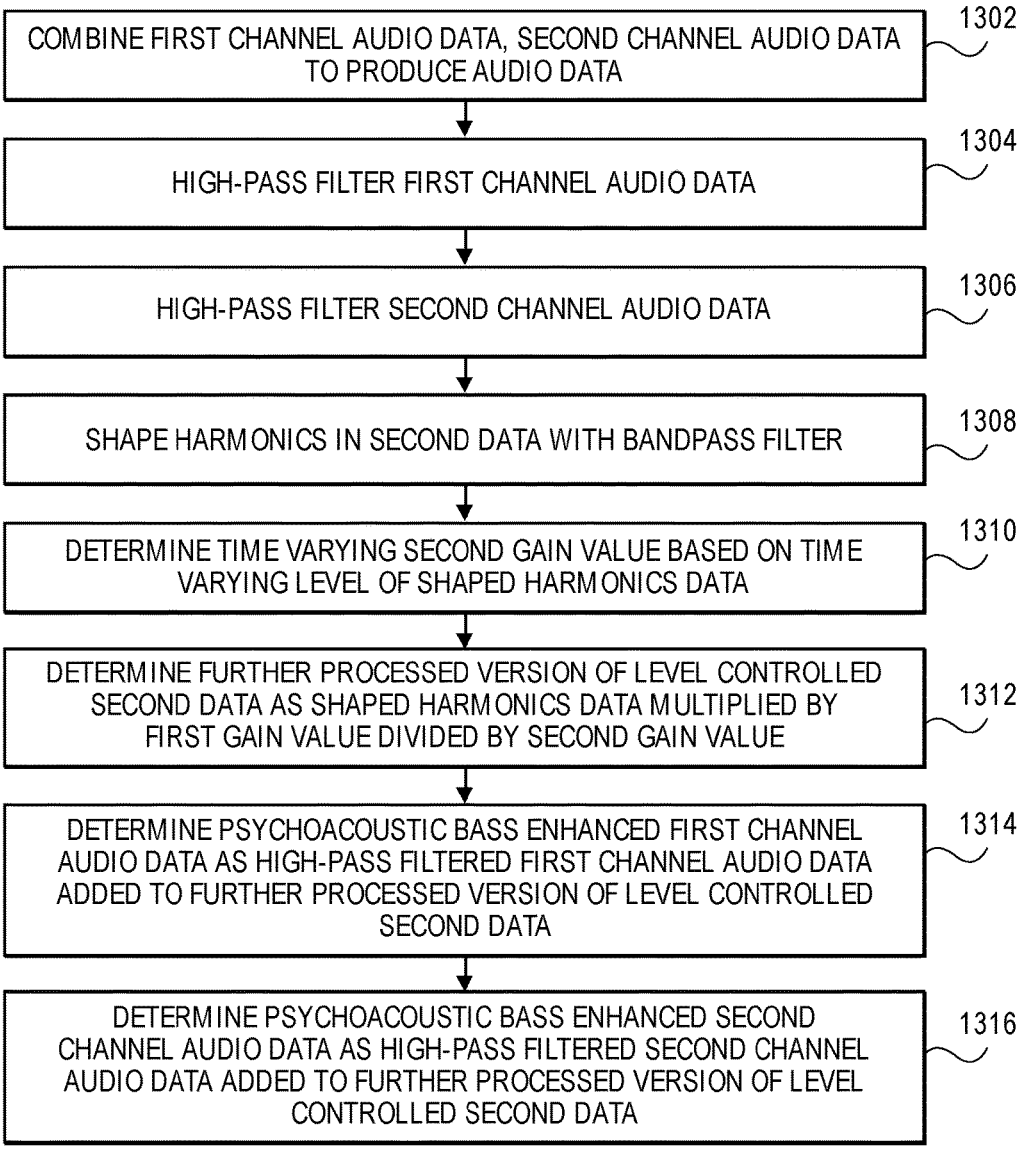
FIG. 13 is a flow diagram of a still further method of processing audio data.

FIG. 13 is a flow diagram of a still further method of processing audio data. This flow diagram adds further actions to the flow diagram of FIG. 11, and the combined method can be performed by psychoacoustic bass enhancement systems shown in FIGS. 4 and 9, and variations thereof. Actions of the flow diagram of FIG. 13 can be used as alternatives or additions to actions of the flow diagram of FIG. 12.

In an action 1302, first channel audio data and second channel audio data are combined to produce audio data.

In an action 1304, the first channel audio data is high pass filtered.

In an action 1306, the second channel audio data is high pass filtered.

In an action 1308, harmonics in the second data are shaped with a bandpass filter. This action references action 1108 of the flow diagram of FIG. 11.

In an action 1310, a time-varying second gain value is determined based on the time-varying level of the shaped harmonics data.

In an action 1312, a further processed version of level controlled second data is determined as shaped harmonics data multiplied by a harmonics gain value multiplied by the first gain value divided by the second gain value. This action references action 1110 of the flow diagram of FIG. 11. One or more equivalent operations could be performed here.

In an action 1314, psychoacoustic bass enhanced first channel audio data is determined as high pass filtered first channel audio data added to the further processed version of level controlled second data.

In an action 1316, psychoacoustic bass enhanced second channel audio data is determined as high pass filtered second channel audio data added to the further processed version of level controlled second data.

While certain aspects have been described and shown in the accompanying drawings, it is to be understood that such are merely illustrative of and not restrictive on the broad invention, and that the invention is not limited to the specific constructions and arrangements shown and described, since various other modifications may occur to those of ordinary skill in the art. For example, while FIG. 4 depicts a device in which a peak follower, a clipper and a nonlinear device are used in an audio electronics system, it is also possible to have other types of level detectors and harmonics generators, and versions with or without a clipper, harmonics shaping bandpass filters, harmonics gain adjustment, etc. Various versions can be implemented in hardware, firmware, software, or a combination thereof, or instructions for a processor, stored in non-transient, tangible, computer-readable media. The description is thus to be regarded as illustrative instead of limiting.

What is claimed is:

1. An audio electronics system comprising:

a first summer to add first channel audio data and second channel audio data to produce audio data;

a first high pass filter to receive the first channel audio data and produce high pass filtered first channel audio data;

a second high pass filter to receive the second channel audio data and produce high pass filtered second channel audio data;

a low pass or bandpass filter to produce first data from the audio data;

a level detector to produce a time-varying first gain based on a time-varying level of the first data;

a harmonics generator to receive as input the first data that has been adjusted by an inverse of the first gain, and to produce second data as harmonics of the input;

a first multiplier to output the second data adjusted by the first gain;

a second summer to add i) the high pass filtered first channel audio data and ii) the second data adjusted by the first gain, to produce psychoacoustic bass enhanced first channel audio data; and a third summer to add i) the high pass filtered second channel audio data and ii) the second data adjusted by the first gain, to produce psychoacoustic bass enhanced second channel audio data.

2. The audio electronics system of claim 1, further comprising:

a clipper to receive as input the first data adjusted by the inverse of the first gain, and whose output is provided as the input to the harmonics generator.

3. The audio electronics system of claim 1, further comprising:

a harmonics shaping bandpass filter to adjust the second data.

4. The audio electronics system of claim 1, further comprising:

a second level detector to produce a time-varying second gain based on a time-varying level of the second data, wherein the multiplier to output the second data adjusted by the first gain comprises the multiplier to output the second data adjusted by the first gain and by an inverse of the second gain.

5. The audio electronics system of claim 1, wherein:

the level detector comprises a peak follower, an envelope detector or an RMS (root mean square) detector; and the harmonics generator comprises a hyperbolic tangent or an exponential.

6. A tangible, non-transitory, computer-readable media having instructions thereupon which, when executed by a processor, cause the processor to perform a method comprising:

adding first channel audio data and second channel audio data to produce audio data;

high pass filtering the first channel audio data to produce high pass filtered first channel audio data;

high pass filtering the second channel audio data to produce high pass filtered second channel audio data;

low-pass or band pass filtering the audio data to produce first data;

generating a time-varying first gain based on a time-varying level of the first data;

multiplying the first data by an inverse of the first gain, or dividing by the first gain, to produce level controlled first data;

generating harmonics of the level controlled first data, as second data;

multiplying the second data by the first gain, to produce level controlled second data;

multiplying a harmonics gain value by the level controlled second data to produce third data;

adding the high pass filtered first channel audio data and the third data to produce psychoacoustic bass enhanced first channel audio data; and adding the high pass filtered second channel audio data and the third data to produce psychoacoustic bass enhanced second channel audio data.

7. The computer-readable media of claim 6, wherein the method further comprises:

clipping a peak from the level controlled first data.

8. The computer-readable media of claim 6, wherein the method further comprises:

bandpass filtering the level controlled second data; and adjusting a level of each band of the band pass filtered level controlled second data.

9. The computer-readable media of claim 6, wherein the method further comprises:

generating a time-varying second gain value based on a time-varying level of the second data, wherein the multiplying the second data by the first gain to produce the level controlled second data comprises multiplying the second data by the first gain and by an inverse of the second gain, to produce the level controlled second data.

10. A method of processing audio data, performed by a processor-based system, the method comprising:

combining first channel audio data and second channel audio data to produce audio data;

filtering the first channel audio data, with a high pass filter, to produce high pass filtered first channel audio data;

filtering the second channel audio data, with a high pass filter, to produce high pass filtered second channel audio data;

filtering the audio data, with a low-pass or band pass filter, to produce first data;

determining a time-varying first gain based on a time-varying level of the first data;

determining level controlled first data as the first data multiplied by an inverse of the first gain or divided by the first gain;

determining second data as harmonics of the level controlled first data;

determining level controlled second data as the second data multiplied by the first gain;

determining third data as a harmonics gain value multiplied by the level controlled second data;

determining psychoacoustic bass enhanced first channel audio data as the high pass filtered first channel audio data added to the third data; and determining psychoacoustic bass enhanced second channel audio data as the high pass filtered second channel audio data added to the third data.

11. The method of claim 10, further comprising:

removing a peak from the level controlled first data.

12. The method of claim 10, further comprising:

shaping the second data with a bandpass filter.

13. The method of claim 10, further comprising:

determining a time-varying second gain based on a time-varying level of the second data, wherein the determining the level controlled second data as the second data multiplied by the first gain comprises determining the level controlled second data as the second data multiplied by the first gain and divided by the second gain.

14. The method of claim 10, wherein:

the determining the time-varying first gain comprises producing an output of a peak follower, an envelope detector or an RMS (root mean square) detector; and the determining the second data as the harmonics of the level controlled first data comprises determining a hyperbolic tangent or an exponential of the level controlled first data.

* * * * *